United States Patent [19]

Barnes et al.

[11] 4,397,572

[45] Aug. 9, 1983

[54] JUSTIFICATION OF OVERSTRUCK TEXT

[75] Inventors: Johnny G. Barnes; Rudolph E. Chukran; Patrick J. Hurley, all of Austin; Harry L. Lineman, Round Rock, all of Tex.

[73] Assignee: International Business Machines Corporation, Armonk, N.Y.

[21] Appl. No.: 273,563

[22] Filed: Jun. 16, 1981

[51] Int. Cl.[3] ..... B41J 19/64

[52] U.S. Cl. ..... 400/3; 400/12; 400/17; 400/64

[58] Field of Search ... 364/200 MS File, 900 MS File; 400/3, 4, 12, 17, 64, 20, 306, 279, 299, 697

[56] References Cited

U.S. PATENT DOCUMENTS 895,720 8/1908 Briggs ..... 400/20

3,630,336 12/1971 Johnson ..... 400/17

FOREIGN PATENT DOCUMENTS 2031626 4/1980 United Kingdom ..... 400/17

*Primary Examiner*—Paul T. Sewell

*Attorney, Agent, or Firm*—Douglas H. Lefeve

[57] ABSTRACT

Overstruck text is justified by distributing the white space residue at the end of the unjustified line among the interword spaces for justification. The amount of the residue distributed is used to determine a number of overstrike characters which will overstrike the text including these expanded interword spaces. This is accomplished by placing controls in the text stream during editing to delineate the text to be overstruck. Before printing, these controls in the edited data stream are detected to cause the print line to be first justified by expansion of interword spaces and then followed by overstriking with the appropriate number of overstrike characters determined during the justification process.

11 Claims, 9 Drawing Figures

JUSTIFICATION OF OVERSTRUCK TEXT

CROSS-REFERENCE TO RELATED APPLICATION

U.S. patent application Ser. No. 159,552, filed June 16, 1980, having J. G. Barnes et al as inventors, and entitled "System and Printer Justification System."

BACKGROUND OF THE INVENTION

1. Field of the Invention

This invention relates generally to the overstriking of text lines to be justified and more specifically to a justification system operative to expand interword spaces in lines of text and to provide the correct number of overstriking symbols to overstrike this justified text.

2. Description of the Prior Art

One technique which has been used in the prior art for graphically distinguishing a portion of text from the remainder of the text in a document is to overstrike all of the text to be so graphically distinguished with a particular overstrike character such as a slash mark. Consider, for example, a legislative bill in the form of a document having provisions currently left standing after committee votes as well as provisions previously defeated by committee vote. While defeated provisions are no longer a part of the proposed legislative bill it may be desirable, during future voting, for the voting legislative body to be able to view all of the provisions which have been considered during the bill's history, including the defeated provisions. Thus, the defeated provisions might be included in the document but overstruck by, for example, a slash mark. In the prior art it has been considered most desirable, from the standpoint of appearance of a document, to have the overstrike characters spaced somewhat uniformily along the lines of the overstruck text. Thus, it has been considered more desirable than not to have the interword spaces of the overstruck text include the overstrike symbols also.

In the document described above it has also been desirable to provide right margin justification of the printed text. Particularly when 100% right margin justification is performed, the right margin of the document is as uniform as the left margin and the document has a highly desirable appearance in its printed form. Automatic right margin justification techniques typically compare a residue of white space between the last text character or symbol and the chosen right margin and relatively evenly divide this residue among the interword spaces on the line so that the last character or symbol on the line abuts the right margin. It will be appreciated, however, that an inherent problem is presented when text overstruck in the manner described above is subjected to this justification process. The divided white space residue which is distributed among the existing interword spaces would, without the aid of the present invention, result in an exhaustion of the overstrike characters before they reached the end of the text desired to be overstruck. This problem would introduce an error in the intended meaning of the overstriking.

It would, therefore, be highly desirable to automatically achieve a uniform distribution of overstrike characters when overstruck text is justified.

SUMMARY OF THE INVENTION

Accordingly, a system and technique are provided for the justification of overstruck text in which the amount of the residue distributed among the interword spaces during justification is used to determine the number of additional overstrike characters which will overstrike the text including these expanded interword spaces. This is accomplished by placing controls in the text stream during editing to delineate the text to be overstruck. Before printing, these controls in the edited data stream are detected to cause the print line to be first justified by expansion of interword spaces and then followed by overstriking with the appropriate number of overstrike characters determined during the justification process.

The foregoing and other features and advantages of the invention will be apparent from the following more particular description of a preferred embodiment of the invention, as illustrated in the accompanying drawing.

DESCRIPTION OF THE PREFERRED EMBODIMENT

Figure 1:
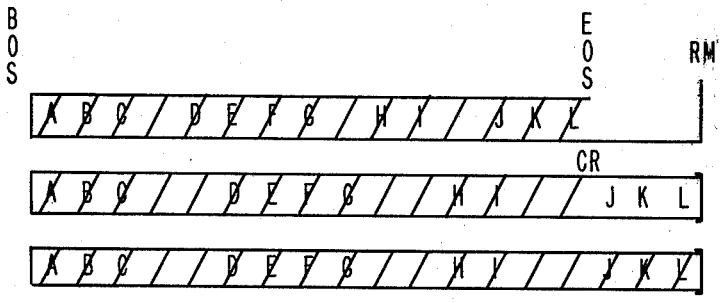
FIG. 1 illustrates a text line: as stored, as would be executed without this invention, and as would be executed with this invention.

In FIG. 1, the first or upper block shown is a representation of an unjustified, overstruck text line stored in a text storage buffer. The letters ABC DEFG HI JKL represent words of varying character lengths on a line of text. At the beginning of the line the operator has keyed a non-printing, non-escaping control code represented as BOS which instructs the system to begin overstriking characters and spaces keyed from this point on. At the end of this line is an EOS, end overstrike, control code which instructs the system to end the overstrike operation. Shown also at this point is a carrier return code to end the entry of characters on this line. A representation of a right margin position is shown to the right of the upper block of text. It will be noted that three character width blocks of white space remain between the last text character keyed on the line before the carrier return code and the right margin position. In the justification routine it is desirable to divide, this residue of white space among the existing interword spaces in the line.

Three interword spaces are shown in the example in the upper portion of FIG. 1. Thus, the residue made up of the three character block widths of white space has been evenly divided and added to the existing interword spaces in the middle portion of FIG. 1. Note, however, that the number of overstriking (slash mark) characters has not been altered by this portion of the justification process. Thus, a part of the text which was overstruck in the draft is, after justification, no longer overstruck. If the operation ended at this point the resulting document would be incorrect from the standpoint of the intended meaning of the overstriking. Referring now to the lower portion of FIG. 1, it will be noted that the number of overstriking characters has been adjusted to overlie the distributed white space with substantially equal spacing between the overstriking characters such that a much more desirable appearance of the overstruck text is presented.

Figure 2:
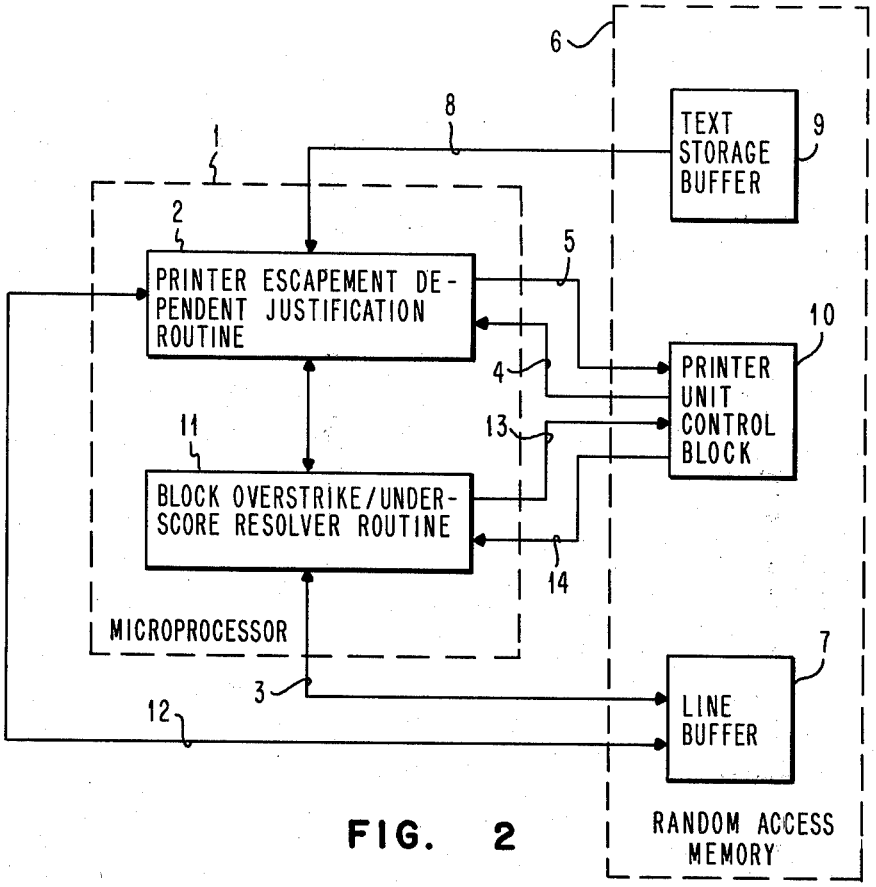
FIG. 2 is a block diagram of the system for handling the block overstriking of text after justification.

Referring to FIG. 2 a block diagram of the system for handling the block overstrike of text after justification is shown. A microprocessor 1 is programmed with a printer escapement dependent justification routine 2 and a block overstrike resolver routine 11. One text line at a time is transferred, by character, from a text storage buffer 9, along line 8 through the microprocessor 1 for justification and overstrike resolution, to a line buffer 7 along line 3. Both the text storage buffer 9 and the line buffer 7 are portions of a random access memory 6.

The minimum escapement unit for the printer to be utilized, as well as other justification parameters such as system minimum escapement unit and space escapement are input to microprocessor 1 along lines 4 and 14 from a printer unit control block 10 which resides in a portion of the random access memory 6. A space count, quotient, remainder, and accumulated printer remainder, etc., are transferred along lines 5 and 13 from the microprocessor 1 to the printer unit control block memory 10.

The printer escapement dependent justification routine 2 of the microprocessor memory interfaces with the block overstrike resolver routine 11 of the microprocessor memory when the beginning or end of an overstrike sequence in the text read from the text storage buffer 9 is processed and transferred to the line buffer 7. The overstrike resolver program resets parameters in the printer control unit block when a begin overstrike sequence is encountered during processing of the line of text. The justification parameters are fetched from the printer unit control block 10 of the random access memory 6, and these parameters are used to resolve the overstrike sequence when an end of overstrike code is detected at the end of the line of text. The data codes in the line buffer 7 are adjusted to contain data that will overstrike the justified text in the improved manner of this invention.

The flow diagrams of FIGS. 3–8 are representative of the decisions and operations performed and controlled by the microprocessor 1 in accordance with instructions from the printer escapement dependent justification routine 2 and the block overstrike resolver routine 11 of FIG. 2. The storage of the instructions of these two routines may be implemented in the form of read only memory with the instructions, therefore, permanently wired thereinto. However, the storage of these instructions may be implemented in the form a random access memory associated with the microprocessor 1 such that the instructions must be loaded thereinto each time power is applied to the system. In another embodiment the processor 1 and the routines 2 and 11 may be replaced entirely by combinational logic such that no processor or "instructions" as such are utilized. The flow diagram described hereinafter will enable any person having skill in the art of computer programming to program a general purpose digital computer to perform the justification and block overstrike techniques according to the principles of the present invention. These flow diagrams will also enable any person having skill in the art of logic design to specify hardware logic in accordance with the concepts of this invention.

Figure 3:
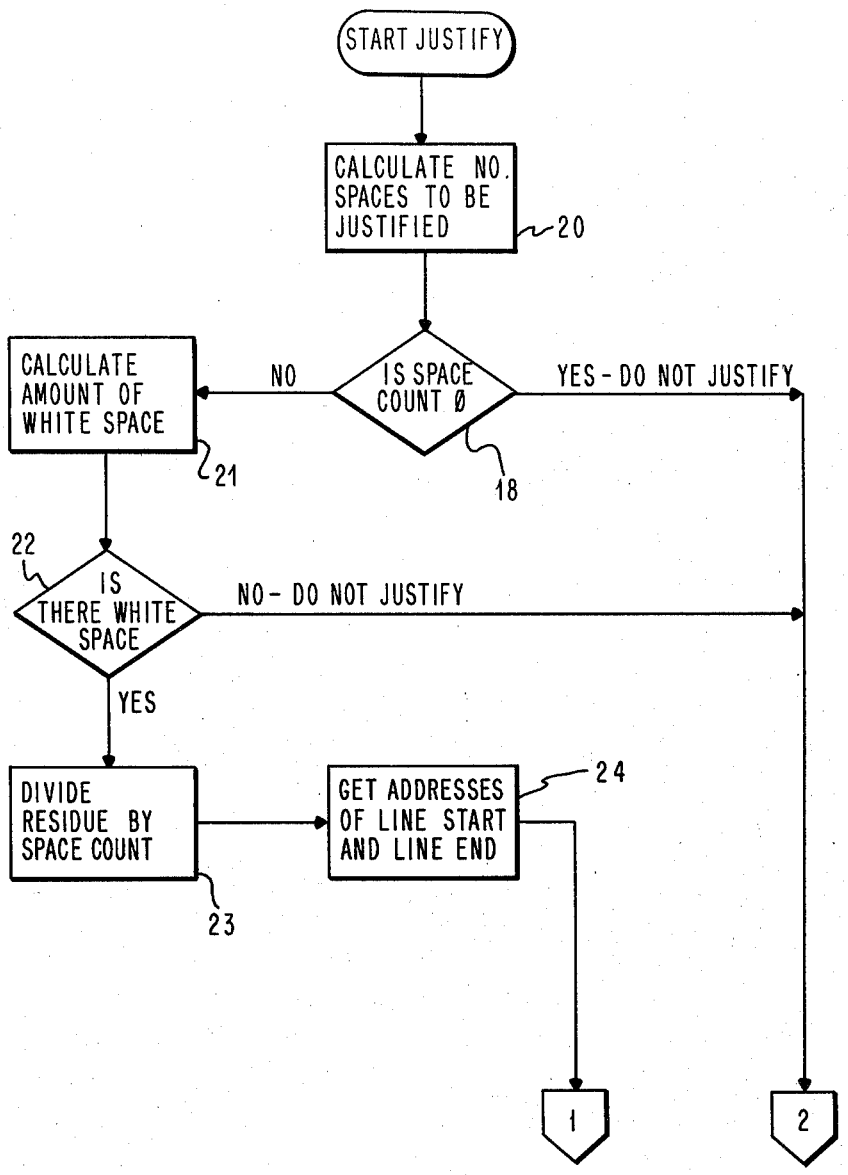
FIGS. 3–8 are flow diagrams illustrating the steps followed in the justification and block overstriking of text lines according to this invention.
Figures 5, 6:
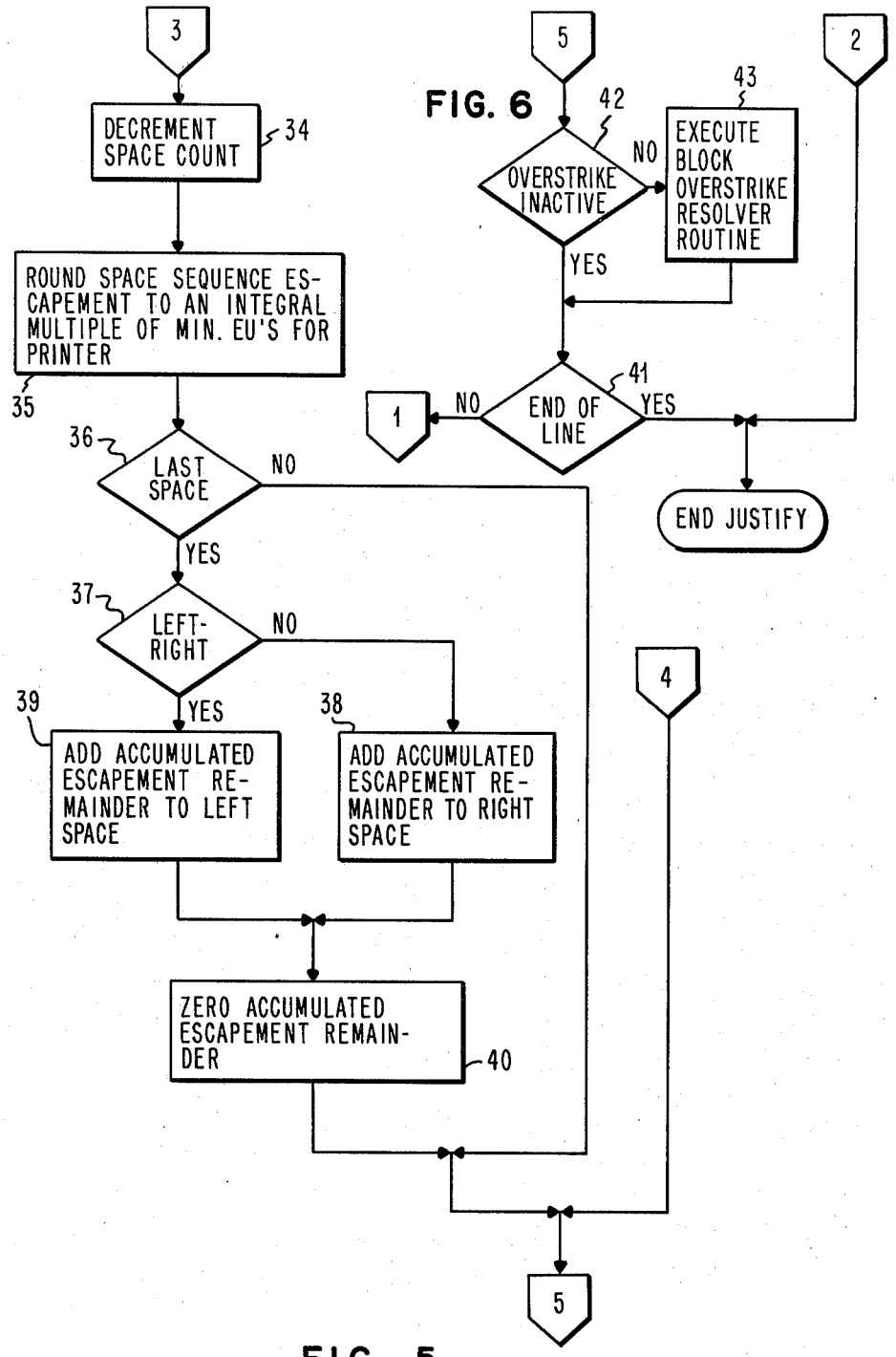

Referring now to FIG. 3, upon a start justify command or signal, a text line stored in the text storage buffer 9 is transferred to the line buffer 7 with each character being scanned to calculate the number of interword spaces within the line as shown at 20, FIG. 3. If there are no spaces, justification is not called for and the technique jumps to the end of the justification routine, as shown at FIG. 6. If spaces exist within the line, at 21 the scanning of the text continues to determine the width, in system escapement units, between the last character in the line of text and the margin which follows. If there is no white space residue the result of the test at 22 is negative and the operation again jumps to the end of the justify routine, FIG. 6. If there is a residue, at 23 the residue is divided by the number of spaces counted at 20 to determine a space expansion factor, which is the integer portion of the quotient, and a remainder. Both the integer portion of the quotient and the remainder are in system escapement, units as is explained in detail in the Cross-referenced application, Ser. No. 159,552. At 24 the starting and ending addresses of the line of text in the text storage buffer 9 are sought.

Figure 4:
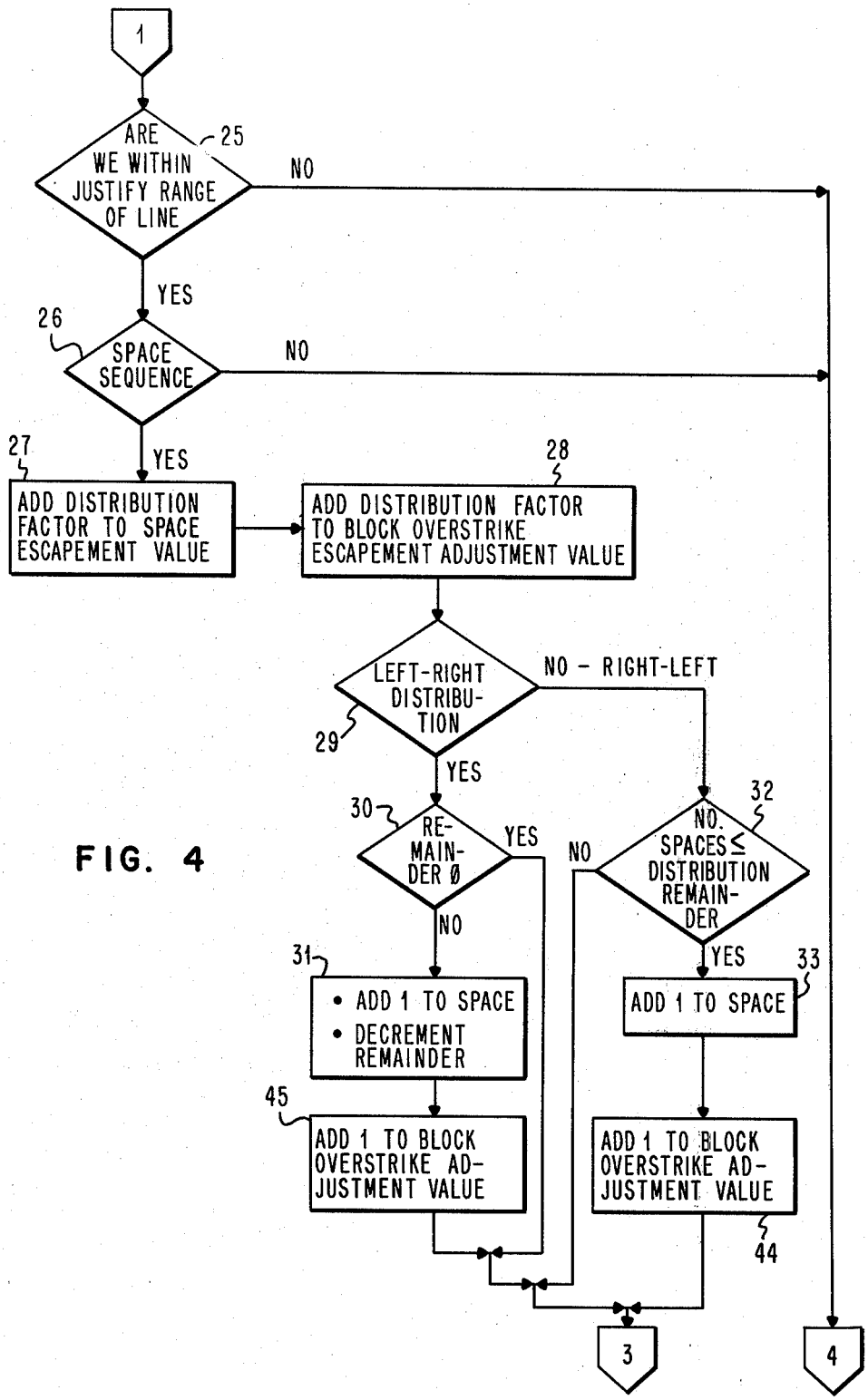

The operation proceeds to 25, FIG. 4. The line start address of the text storage buffer 9 is now addressed and the test at 25 is to determine whether or not the text being addressed at the test storage buffer 9 is within the justification range of the line. If, for example, there is a tab at the beginning of the line, justification cannot begin until the first interword space following the text following this tab. If the result of the test at 25 is positive a test is made at 26 to determine whether an interword space or space sequence is presently being addressed. If so, at 27 a distribution factor is added to the space escapement value. The distribution factor is the integer portion of the quotient determined at 23, FIG. 3. The interword space in the text storage buffer 9 to which the space expansion factor is added was assigned a minimum space size defined as a preselected number of system minimum escapement units. As a result of the operation at 27, the integer portion of the quotient obtained earlier has been added to this minimum space size. At 28 the integer portion of the quotient determined at 23, FIG. 3, is also added to a block overstrike escapement adjustment value. The block overstrike escapement adjustment value is the escapement of that portion of any white space residue which is distributed among the interword spaces in overstruck text.

It will be noted that a negative result of either of the tests 25 or 26 directs operation of the technique through FIG. 5 to the test 42, FIG. 6, to determine whether the overstrike mode is inactive as a result of either a failure to detect a begin overstrike code or the previous occurrence of an end overstrike code. If the overstrike mode is inactive a test at 41 is performed to determine whether the storage location in the text storage buffer 9 is the end of line address determined at 24, FIG. 3. If so, the justify routine is ended, but if not the operation loops back to the test at 24. If the overstrike mode is active the operation at 43 proceeds through the overstrike resolver routine shown in FIGS. 7–9, as will be discussed hereinafter. At the completion of the block overstrike resolver routine, the operation proceeds through the test at 41, as described above.

Each time a negative test at 41 occurs the text storage buffer address pointer is incremented by one and the operation loops back to the test at 25, FIG. 4, to determine whether the next code in the text storage buffer is within the justify range of the line and is an interword space code or sequence of codes to which the distribution of white space may be added.

In FIG. 4 a test is made at 29 to determine whether distribution of the remainder portion of the quotient obtained at 23, FIG. 3, is to begin from the left end of the text line and proceed to the right or is to begin from the right end of the text line and proceed to the left. If the distribution is left to right a test is made at 30 to determine whether the remainder has been exhausted. If so the operation proceeds to 34 at FIG. 5, as indicated. If not, at 31 a single system escapement unit is added to the space expanded at 27, FIG. 4, and the count of the remainder is decremented by one. Thereafter, one system escapement unit is added to the block overstrike adjustment value at 45.

If the test at 29, FIG. 4 indicates right to left distribution of the remainder a test is made at 32 to determine whether the number of spaces on the line is less than or equal to the distribution remainder. If so, at 33 one system escapement unit is added to the space expanded at 27, FIG. 4, after which one system escapement unit is added to the block overstrike escapement adjustment value at 44. If not, operation proceeds directly to FIG. 5, wherein the space count is decremented at 34.

The operation proceeds to 35 wherein printer justification of the line begins. The space sequence determined at 27, FIG. 4, as adjusted at 31 and 33, FIG. 4, is rounded to an escapement equal to an integral multiple of the printer minimum escapment unit. This printer minimum escapement unit parameter is stored in the random access memory 6, FIG. 2, in the printer unit control block 10 thereof. Thereafter, a test is made at 36 by comparing the current space count to zero to determine whether the space presently being addressed in the text storage buffer 9 is the last space on the line. If not, the operation proceeds through the tests at 42 and 41, FIG. 6 for possible scanning of the next character on the line if the result of the test at 41 is negative. If the space being tested at 36 is the last space on the line the operation proceeds to the test at 37 to, again, determine whether left to right or right to left scanning of the text is presently taking place. If the scanning is left to right, at 39 the difference between the escapement before and after the rounding off operation at 35 is added to the leftmost interword space on the line. If scanning is right to left, at 38 the difference obtained in the rounding off operation at 35 is added to the rightmost interword space on the text line. In either case the accumulated escapement remainder counter is cleared at 40 and the operation proceeds to the test at 42 to determine whether the overstrike mode is inactive. If so, the test at 41 is performed to determine whether the line has ended. If not the operation proceeds through the block overstrike resolver routine of FIGS. 7–9, as will be described hereinafter, before returning to the test at 41. The operation continues to loop from a negative result of the test at 41, FIG. 6, to the test at 25, FIG. 4, until each storage position in the text buffer 9 from the line starting address through the line ending address has been processed as described above. When the end of the line is reached a positive result of the test at 41, FIG. 6 brings the justification process to an end.

Figure 7:
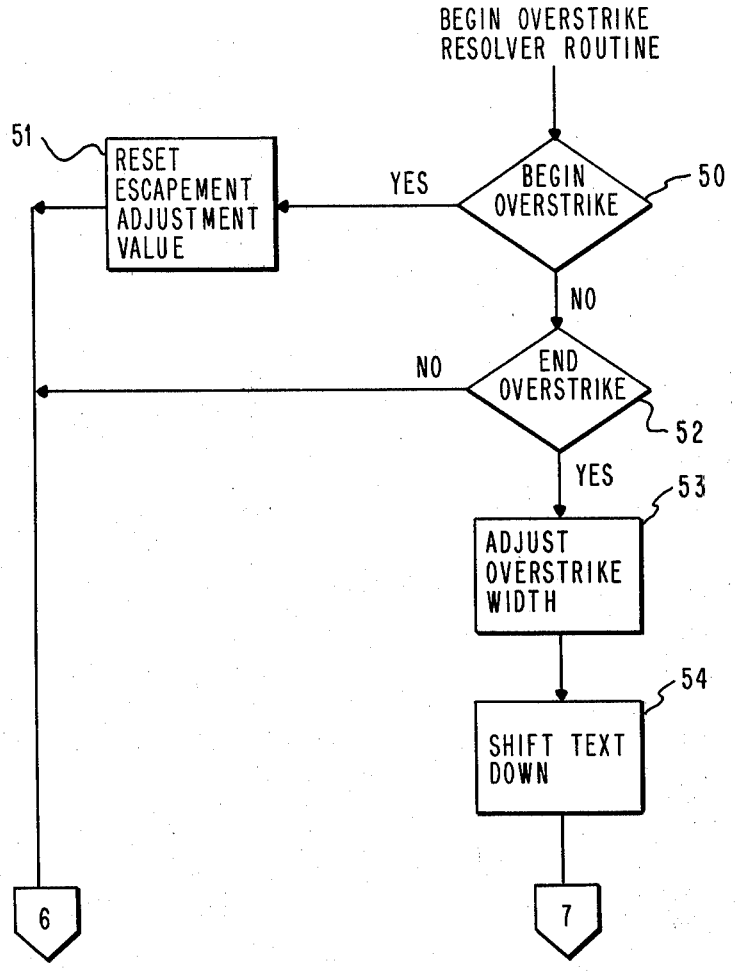
Figure 8:
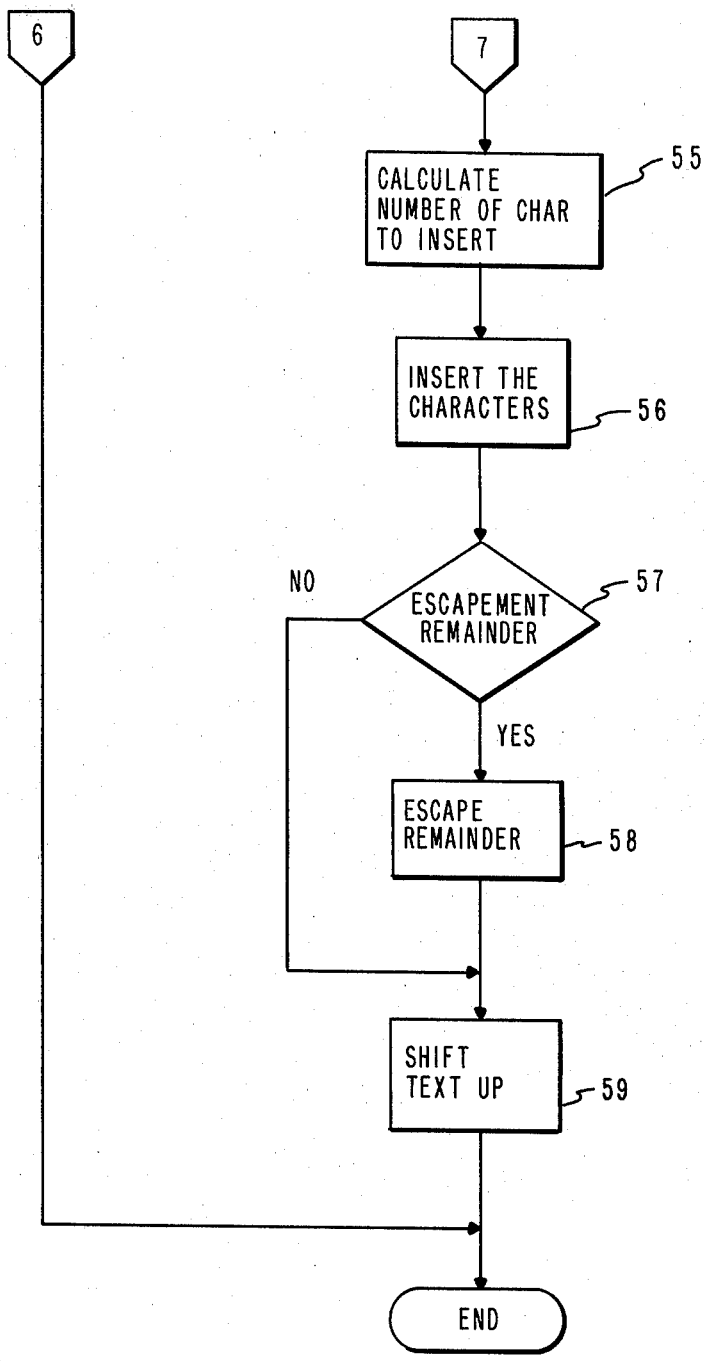

Referring now to FIGS. 7 and 8 the block overstrike resolver routine is described as follows. The operation begins with a test at 50 to determine whether the code presently being addressed in the text storage buffer 9 is a begin overstrike control code. If so, at 51 the escapement adjustment value is reset to zero. If not, a test at 52 is performed to determine whether the code presently being addressed in the text storage buffer 9 is an end overstrike control code. If not, operation proceeds to the end of this routine and continues to the test at 41, FIG. 6. If so, at 53 the width of the text being overstruck is adjusted to compensate for the justification process. The escapement is adjusted by adding the escapement adjustment value to the original width of the text. Next, at 54 the remainder of text in the line buffer 7 is shifted to the end of the buffer to open storage space in the buffer for the overstrike characters to be added to the text stream.

This number of overstrike characters is not calculated until the next step in the operation shown at 55, FIG. 8. Thus, it is necessary to move all of the remaining text to the end of the line buffer 7 to make room for the overstrike characters that are calculated to be inserted at 55, FIG. 8. At 56, a backspace sequence and the overstrike characters are inserted into the line buffer immediately following the last character in the text bounded by the overstrike controls. The backspace sequence is equal to the escapement calculated at 53. Next, at 57 a test is made to determine whether the amount of escapement that will be executed by the additional number of inserted overstrike codes is fully equal to the residue of white space previously determined. If so, there is no escapement remainder and operation proceeds to 59 as will be discussed below. If there is a difference between the amount of escapement added by the inserted overstrike characters and the escapement of the backspace sequence, the result of the test at 57 is positive, and this escapement remainder is added to the text stream as a control code to require the printer to escape to the appropriate right or left margin before continuing its operation when this text is printed. Following this, the remaining text that was shifted to the end of the line buffer 7 is shifted back up in the buffer to abut the end of the overstrike characters added or the printer escapement remainder added at 58. Following this, operation returns to the test at 41, FIG. 6.

Figure 9:
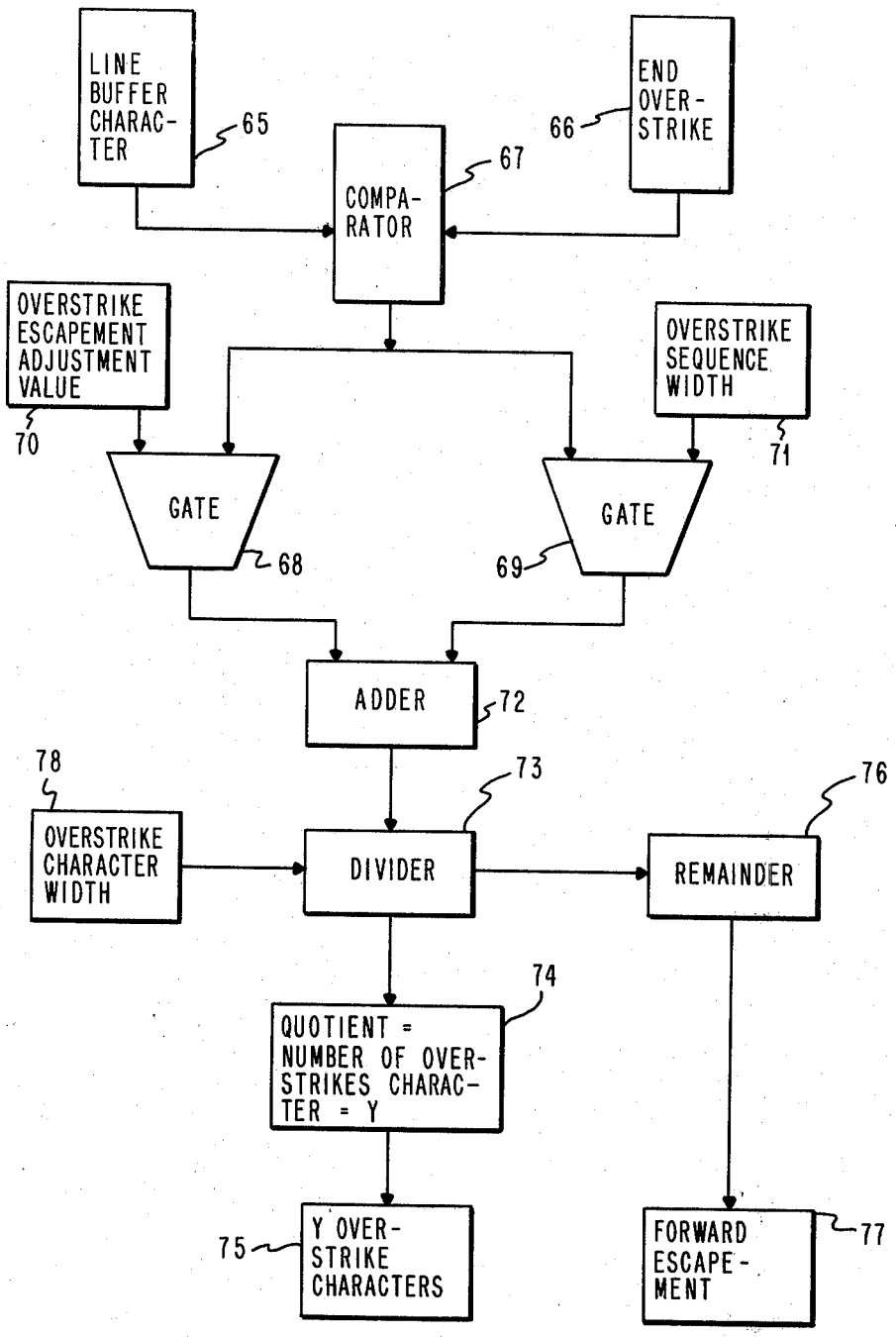
FIG. 9 is a block diagram illustrating structure for justifying text lines and overstriking the text lines according to this invention.

Referring now to FIG. 9, the operation of the block overstrike resolver routine is described with reference to the logic structure shown. As each code is read from the text storage buffer 9, processed by the microprocessor 1, and loaded into the line buffer 7, this code indicated by a character 65 is compared with an end overstrike code 66 at comparator 67. When the character 65 being processed compares with the end overstrike code 66 the comparator 67 outputs a signal that conditions AND gate 68 to gate the overstrike escapement adjustment value 70 to an adder 72. Simultaneously, the output signal from comparator 67 enables AND gate 69 to gate the overstrike sequence width 71 to the adder 72 such that this width and the overstrike escapement adjustment value are added. At 73 this sum is divided by the overstriking character width 78 and at 74 the integer portion of the quotient obtained by the divider 73 equals the number Y of overstrike characters which are to be added to the line of text. The input of the overstrike characters is denoted at 75, FIG. 9. The remainder beyond the integer obtained during the division by divider 73 is transferred to the storage 76. At 77 the remainder is converted to the forward escapement necessary to move the printer to the nearest margin when all of the overstrikes have been executed. With the addition of this forward escapement the printer ends each line at the margin in a manner consistent with fully justified text.

Thus, a system and technique are provided for the justification of overstruck text in which the amount of the residue distributed among the interword spaces during justification is used to determine a number of additional overstrike characters which will overstrike these expanded interword spaces. This is accomplished by placing begin overstrike and end overstrike control codes in the text stream during editing to delineate the text to be overstruck. Before printing, these controls in the edited data stream are detected to cause the print line to be first justified by expansion of interword spaces and then followed by overstriking with the appropriate number of extra overstrike characters determined during the justification process. These overstrike characters are, in a sense, then themselves justified by intercharacter adjustment of the spacing between the overstrike characters.

While the invention has been particularly shown and described with reference to a preferred embodiment thereof, it will be understood by those skilled in the art that various changes in form and details may be made therein without departing from the spirit and scope of the invention.

What is claimed is:

1. In a system operable to provide right margin justification of lines of text stored in a text storage buffer the improvement comprising:

means for expanding interword spaces between words in said lines of text by dividing an unjustified end of line white space residue among existing interword spaces;

means for detecting a begin overstrike control code and an end overstrike control code in said lines of text; and means for providing a plurality of overstrike characters to overlay the words and said expanded spaces between words bounded by one of said begin overstrike control codes and one of said end overstrike control codes, said means for providing a plurality of overstrike characters further including;

means for obtaining a first quotient by dividing an escapement width of said overstrike character into the white space residue distributed among interword spaces on a line between one of said begin overstrike control codes and one of said end overstrike control codes or an end of line control code; and means for adding a number of overstrike characters to said line of text and overstrike characters, the number of said additional overstrike characters being related to said quotient.

2. In the system of claim 1 wherein said means for adding said number of overstrike characters further comprises means for adding said overstrike characters equal to the integer portion of said first quotient.

3. In the system of claim 2 wherein said means for adding said number of overstrike characters further comprises means for adding a backspace control code following a text code immediately succeeded by an end overstrike control code or an end of line control code, the reverse escapement of said backspace control code being equal to the forward escapement of said number of overstrike characters.

4. In the system of claim 3 wherein said means for adding said number of overstrike characters further comprises means for adding said overstrike characters following said backspace control cage.

5. In a system of claim 4 further comprising:

line buffer means for storing a line of text including text character codes, control codes, and overstrike codes to be printed;

means for transferring one of said lines of text from said text storage buffer to said line buffer.

6. In the system of claim 5 wherein said means for adding overstrike characters comprises means for shifting all codes to the end of said line buffer following an end overstrike control code detected among said codes transferred from said text storage buffer to said line buffer.

7. In the system of claim 6 wherein said means for adding overstrike characters further comprises means for inserting said backspace control code in said line buffer in place of said end overstrike control code or following said end of line control code.

8. In the system of claim 7 wherein said means for adding overstrike characters further comprises means for inserting said overstrike characters into said line buffer immediately following said backspace control code.

9. In the system of claim 8 further comprising means for inputting an escapement control code into said line buffer immediately following said overstrike characters, the escapement specified by said escapement control code being related to the fractional portion of said first quotient.

10. In the system of claim 9 wherein said means for adding overstrike characters further comprises means after inputting said escapement control code into said line buffer for shifting all codes in said line buffer previously shifted to said end of said line buffer such that the first of said previously shifted codes immediately follows the last of said overstrike characters or escapement control code.

11. In a method operable to provide right margin justification of lines of text stored in a text storage buffer the improvement comprising:

expanding interword spaces between words in said lines of text by dividing an unjustified end of line white space residue among existing interword spaces;

detecting a begin overstrike control code in one of said lines of text; and providing a plurality of overstrike characters to overlay the words and said expanded spaces between words between said begin overstrike control code and an end overstrike control code or the end of said line of text, said step of providing a plurality of overstrike characters further including;

obtaining a first quotient by dividing an escapement width of said overstrike character into the white space residue distributed among interword spaces on a line between one of said begin overstrike control codes and one of said end overstrike control codes or an end of line control code; and adding a number of overstrike characters to said line of text and overstrike characters, the number of said additional overstrike characters being related to said quotient.

* * * * *

UNITED STATES PATENT AND TRADEMARK OFFICE

CERTIFICATE OF CORRECTION

PATENT NO. : 4,397,572

DATED : August 9, 1983

INVENTOR(S) : R. E. Chukran, et al

It is certified that error appears in the above—identified patent and that said Letters Patent is hereby corrected as shown below:

Col. 8, line 2, "cage" should be "code". (Claim 4)

Signed and Sealed this

*Sixth* Day of *March 1984*

[SEAL]

*Attest:*

GERALD J. MOSSINGHOFF

*Attesting Officer*

*Commissioner of Patents and Trademarks*